United States Patent [19]

Abarotin

[11] Patent Number: 4,746,098

[45] Date of Patent: May 24, 1988

[54] APPARATUS FOR REMOVING AND REPLACING MANHOLE COVERS AND GRATINGS

[75] Inventor: Eugene V. Abarotin, Murrysville, Pa.

[73] Assignee: Design & Analysis of Mechanisms & Structures, Inc., Murrysville, Pa.

[21] Appl. No.: 89,570

[22] Filed: Aug. 26, 1987

[51] Int. Cl.[4] ..... B66F 11/00

[52] U.S. Cl. ..... 254/130; 254/131

[58] Field of Search ..... 254/131, 129, 130, 120–123; 294/15, 17, 91, 89; 414/684.3; 280/47.27

[56] References Cited

U.S. PATENT DOCUMENTS

| | | | |
|---|---|---|---|
| 2,086,318 | 7/1937 | Jackson | 294/17 |
| 2,655,399 | 10/1953 | McMillan | 294/17 |
| 2,832,628 | 4/1958 | Turnbull | 294/17 |
| 2,846,259 | 8/1958 | Sadler | 294/15 |
| 3,275,299 | 6/1964 | Meshew | 254/131 |
| 3,957,247 | 5/1976 | Haller et al. | 254/1 |
| 4,076,217 | 2/1978 | Haller et al. | 254/131 |
| 4,157,809 | 6/1979 | Haller et al. | 254/131 |
| 4,157,810 | 6/1979 | Haller et al. | 254/131 |
| 4,157,811 | 6/1979 | Haller et al. | 254/131 |
| 4,365,925 | 12/1982 | Girtz | 414/684.3 |
| 4,488,706 | 12/1984 | Kono | 254/131 |

FOREIGN PATENT DOCUMENTS

| | | |
|---|---|---|
| 3131468A-1 | 3/1983 | Fed. Rep. of Germany . |
| 1183614 | 7/1959 | France . |
| 1438529 | 4/1965 | France . |
| 1031712 | 6/1966 | United Kingdom . |
| 2045206A | 10/1980 | United Kingdom . |

OTHER PUBLICATIONS

Diversified Products & Engineering, Inc., (Monroeville, PA), Advertisement in *Government Product News,* p. 7, Jan. 1982.

*Primary Examiner*—Robert C. Watson

*Attorney, Agent, or Firm*—Elliott V. Nagle

[57] ABSTRACT

An improved lever and pivot device for lifting and moving a load is disclosed which is particularly suitable for removing and replacing manhole covers and gratings.

17 Claims, 5 Drawing Sheets

APPARATUS FOR REMOVING AND REPLACING MANHOLE COVERS AND GRATINGS

BACKGROUND OF THE INVENTION

This invention relates in general to devices for use in lifting and moving a load and in particular to apparatus for removing and replacing manhole covers and gratings.

Many years ago it was recognized there is a need for a special device to enable workers to remove manhole covers and gratings more safely and easily than with simple tools. Numerous inventions have been patented in an attempt to fill this need; however, of all those I have been able to find, all appear to me in themselves to introduce safety hazards into the work and appear to require great skill and care if they are to be used without accident, or appear unsatisfactory for other reasons. Part of the problem is that over the years manhole covers weighing up to 500 pounds have come into use. Many of the devices cannot be used with or will fail under such loads. Some can not practically be repaired. Some it seems would allow the cover to swing into and break a worker's leg. Others might slip and allow a handle to hit the worker, or lead the worker to step into a dangerous position, or lead the worker to assume a posture that leads to back injury. Others look unwieldy to store or transport, expensive to manufacture, or otherwise unsuitable for daily use. Some of the devices only work satisfactorily on a stable floor or are only useful for loads that have specific kinds of points of attachment. Some that might be useful for removing manhole covers and gratings appear of little or no use in replacing them. The dissappointing fact of the matter is that the current general practice is still the use of simple bars and brute strength, and the need for a better device remains unfilled.

SUMMARY OF THE INVENTION

The primary object of the present invention is to provide a device for removing and replacing manhole covers and gratings safely.

It is another object of my invention to provide a device for removing and replacing manhole covers and gratings that is inexpensive to manufacture.

It is another object of my invention to provide a device for removing and replacing manhole covers and gratings which will not fail under loads up to 500 pounds and has a substantial margin of strength for heavier loads which might accidentally be lifted.

It is another object of my invention to provide a device for removing and replacing manhole covers and gratings, every member of which can be repaired.

It is another object of my invention to provide a device for removing and replacing manhole covers and gratings that is sufficiently lightweight for manual use and can be conveniently stored and transported.

It is another object of my invention to provide a device for removing and replacing manhole covers and gratings that can be adjusted elevationally to accommodate a variety of load configurations.

It is another object of my invention to provide a device for removing and replacing manhole covers and gratings which can utilize a variety of means to engage a load.

It is another object of my invention to provide a device for removing and replacing manhole covers and gratings which can employ a plurality of load engaging means.

It is another object of my invention to provide a device for removing and replacing manhole covers and gratings with load-engaging means that are positionally adjustable horizontally and vertically.

It is another object of my invention to provide a device for removing and replacing manhole covers and gratings which may be operated by a plurality of workers simultaneously.

These and other objects are achieved by an improved lever and pivot device which comprises a base which supports a swivel which in turn supports a pivotable post that is equipped at a plurality of elevationally different positions for the selective attachment of a lever. The option of attaching the lever to the post at elevationally different positions is particularly advantageous in that it allows the device to be used to remove manhole covers and gratings in locations where they could not be satisfactorily manipulated with other devices. For example, the point of attachment can be lowered sufficiently on the post that the device can be used to remove and replace a manhole cover when a truck is parked over it. On the other hand, the point of attachment can be raised so that the device can be used to remove and replace a cover on the end of a pipe that projects above the ground—for example, on a hillside. The lever is detachably engaged, which allows the device to be disassembled for more compact storage and convenience of transport; this feature also allows that levers of different length or other special features can be interchanged on the same post. The lever is fabricated of structural channel members and equipped for the adjustable attachment of one or more load-engaging means. In one embodiment of the invention the lever has members which slide telescopically and automatically lock the lever in extended configuration for use or in contracted configuration for storage or transport.

The lever is fabricated by joining spaced parallel carbon-steel channel members with welded-on spacer-plates to form a beam which has a yield strength well in excess of 20,000 pounds per square inch, which is the maximum calculated stress for a 500 pound load. Use of this carbonsteel structure instead of a design employing higher-strength but more expensive and exotic metals gives great advantages. The use of the steel structure makes it possible to manufacture the device at lower cost, and whereas the other metals require highly specialized welding techniques, parts of my device that accidentally become bent can be straightened or cut out and replaced by welding in the field. Compared to devices that employ levers that include solid bars, the present invention is much lighter in weight and therefore can be transported without a vehicle. Furthermore, the detachability of the lever makes the device quite suitable for storage. The embodiment which includes a telescoping lever is particularly suitable for storage, for example, in the trunk of an automobile. My device also allows attachment of a plurality of load-engaging means when appropriate to prevent uncontrolled motion of a load while it is being moved. The base can be positioned on the ground as well as on floors and pavements and the point of attachment of the lever can be elevationally adjusted and the points of attachment of the load-engaging means can be adjusted horizontally and vertically to accommodate a variety of load configurations. The handle of the lever is designed so that a pipe or rod can be inserted through it to enable a plurality of workers to operate the device in unison. All of these features of the invention make it more suitable to general and everyday use than any of the devices known heretofore.

BRIEF DESCRIPTION OF THE FIGURES

Further objects and advantages and a better understanding of the invention may be had from the following detailed description taken in connection with the accompanying drawings, wherein.

DETAILED DESCRIPTION OF THE FIGURES

Although the invention will be explained in conjunction with removing and replacing manhole covers and gratings, it should be understood by those skilled in the art that other uses may be found for the apparatus of my invention.

Figure 1:
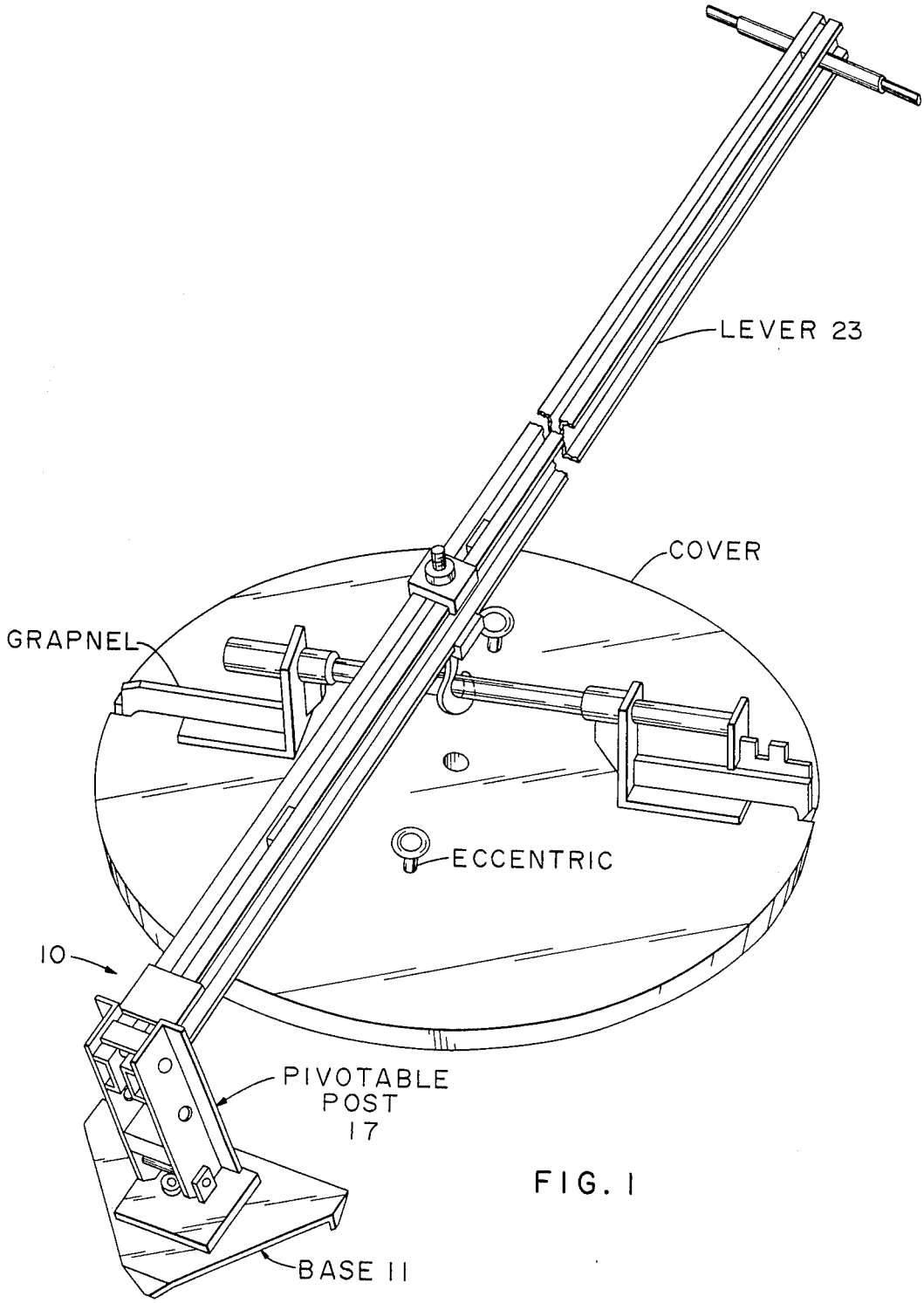
FIG. 1 is a schematic perspective view showing the use of my invention with means to engage a manhole cover having holes or recesses at its periphery and illustrating the principles of the invention; also appearing in FIG. 1 are two devices called "eccentrics" that are more fully shown and described below.
Figure 2:
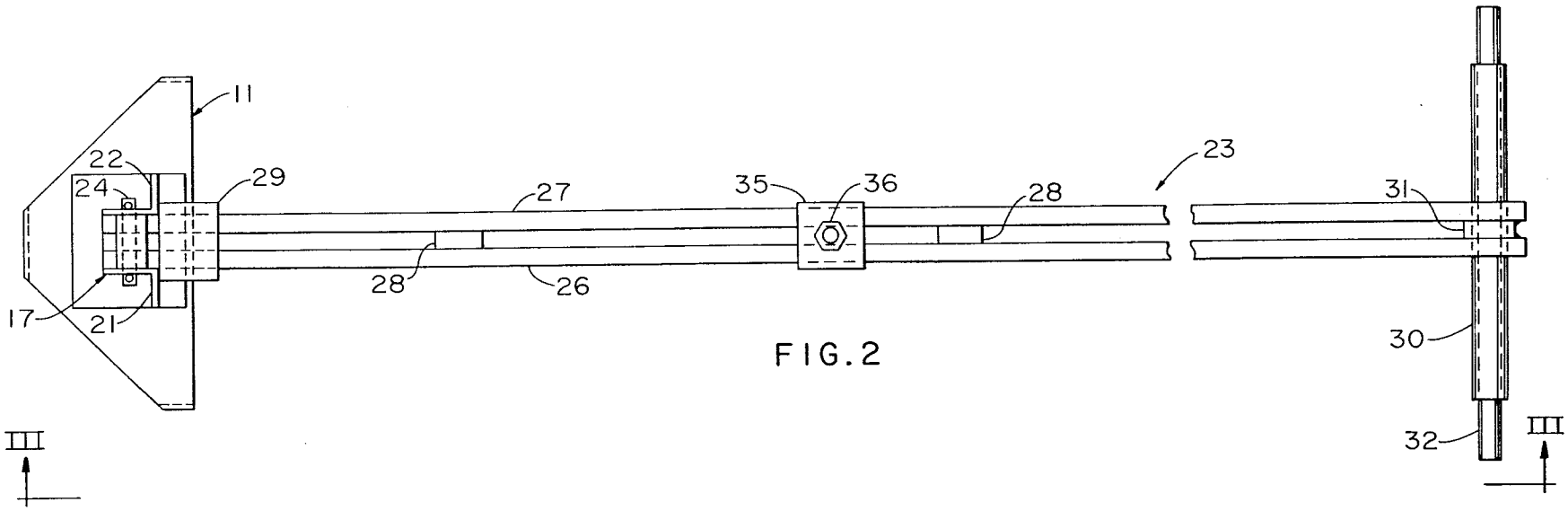
FIG. 2 is a plan view of my invention.
Figure 3:
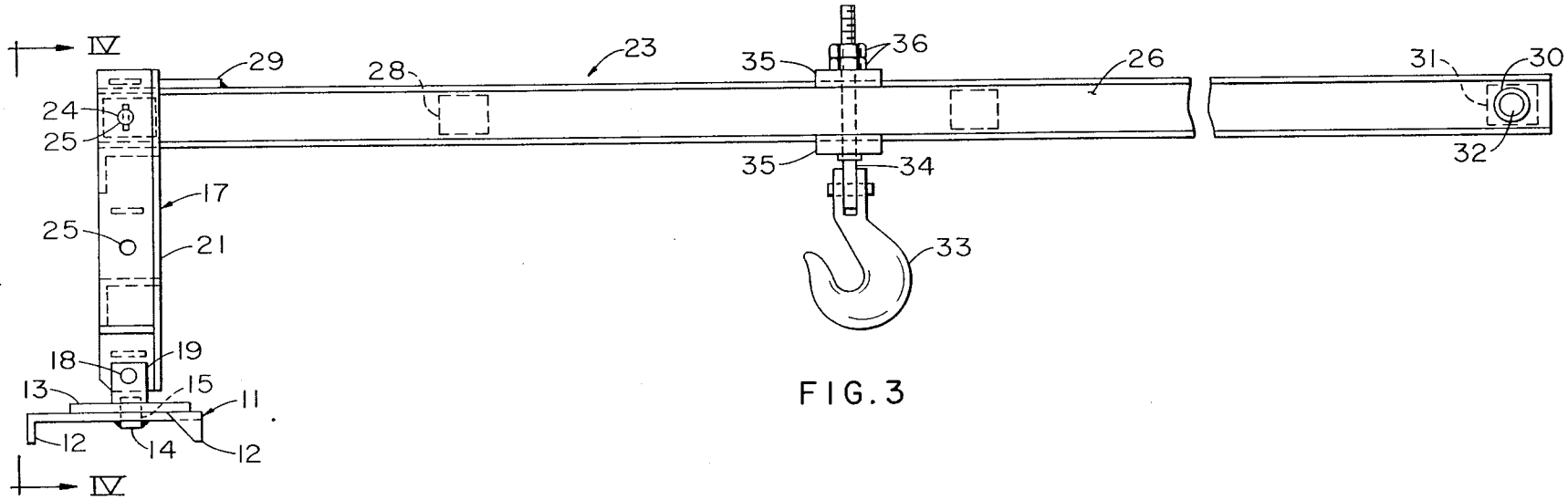
FIG. 3 is a side elevational view of the structure taken on line III—III of FIG. 2.
Figure 4:
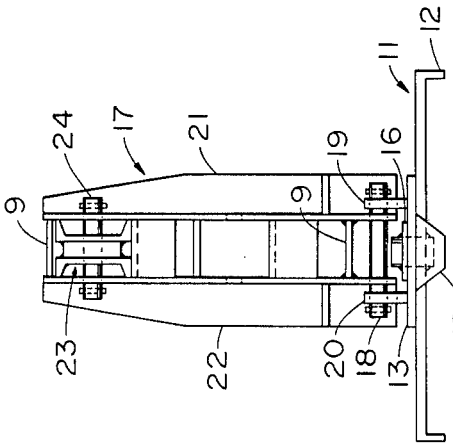
FIG. 4 is an elevational view taken on line IV—IV from the left end of FIG. 3.

With reference to FIGS. 1–4, a device illustrating a first embodiment of the present invention is designated in its entirety by the reference numeral 10. The device comprises a base 11 which is preferably triangle-shaped in the horizontal plane and has a leg 12 depending from each corner, the tripod base being preferred for stability. A rotatable member 13 is mounted on the base 11 for rotation about an axis perpendicular to the base 11. With reference to FIGS. 3 and 4, member 13 may be secured to base 11 in a number of ways although I prefer a stud 14 fitting through an aperture 15 in base 11 and held in place by a flat washer 16 welded to stud 14. A pivotable post, generally designated 17, fabricated as a weldment, is mounted on the rotatable member 13 for rotation about an axis of member 13 perpendicular to the axis of rotation of the rotatable member 13. Post 17 is pivoted on a rod 18 secured to rotatable member 13 by two vertical plates 19 and 20. Rod 18 is secured in its position by two cotter pins, one outside of each of the vertical plates. Pivotable post 17 consists of two steel angles 21 and 22 connected at predetermined intervals by spacer plates 9. The space between the top of steel angle 21 and the angle 22 is designed to snugly receive one end of a lever, generally designated 23, and to retain the lever with a removable transverse pin 24 secured by two cotter pins. The lever 23 is thus detachably engagable with the pivotable post 17 and can be mounted at one of several elevationally different positions such as at aperture 25 shown in FIG. 3.

In the embodiment illustrated in FIG. 2–4 the lever comprises two spaced parallel longitudinal steel structural channels 26 and 27 connected at predetermined intervals by welded-on steel spacer-plates 28 to provide a rigid beam. A stop plate 29 is located on the lever 23 near the end of the lever 23 that attaches to the pivotable post 17; the stop plate 29 butts against the pivotable post 17 and when the lever is lifted, as will be described below, the stop plate limits the angle between the lever and the pivotable post to a maximum of 90 degrees and also serves as a locator for pin 24. At the opposite end of the lever 23 a member 30 is snugly inserted through appropriate apertures in the steel channels 26 and 27 and steel spacer-plate 31 and welded in place perpendicular to the webs of the channels to serve as a handle. I prefer that member 30 be a tubular member that allows for another, longer member 32 of smaller diameter to be inserted through it to provide an extension that enables operation of the device by more than one person.

As a demountable load-engaging means in FIGS. 2–4, a hook 33 is mounted on an eyebolt 34 and the shank of the eyebolt passes between the two channel members 26 and 27 and through two mounting plates 35. The eyebolt is secured with two nuts 36 on the top of the shank above the top plate 35. The hook 33 can be lowered by unscrewing the eyebolt 34 in or out of the nuts 36 and by shimming between plate 35 and eyebolt 34. This arrangement also enables the hook to be oriented relative to lever 23 to suit the orientation of a point of attachment on the load or to suit the orientation of any supplementary load-engaging means such as a grapnel. In addition, the hook assembly can be adjusted laterally along the length of lever 23 to accommodate various load positions.

Figure 5B:
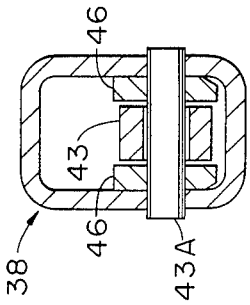
FIG. 5A and FIG. 5B are cross-sectional views taken on lines VA—VA and VB—VB of FIG. 5.
Figure 5A:
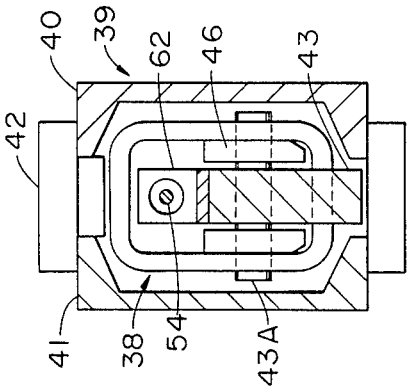
Figure 5:
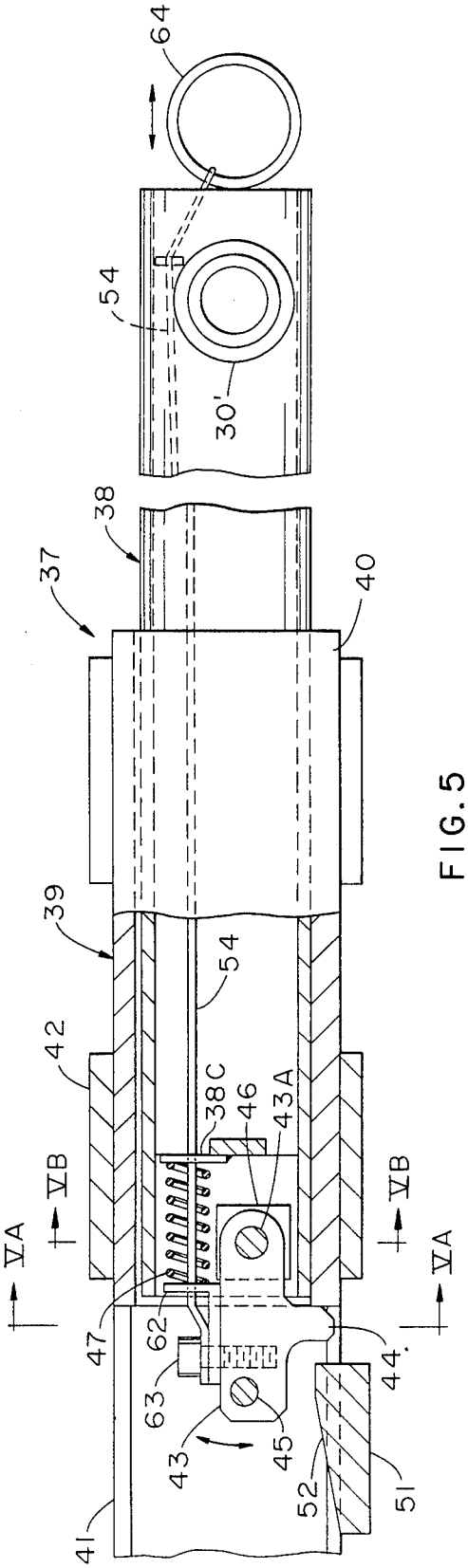
FIG. 5 is a partial elevational view of a sectional assembly of another embodiment of my invention which has a lever with members that slide telescopically and automatically lock the lever in extended or contracted configuration.
Figure 6:
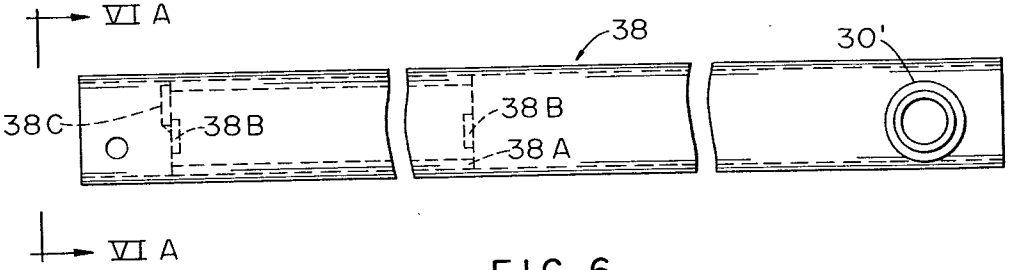
FIG. 6 is an elevational view, from the side, of the sliding member of the telescoping lever .
Figure 6A:
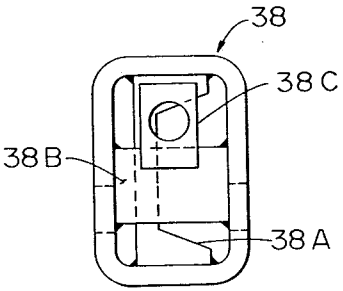
FIG. 6A is an enlarged end view of FIG. 6 taken on line VIA—VIA.
Figure 7:
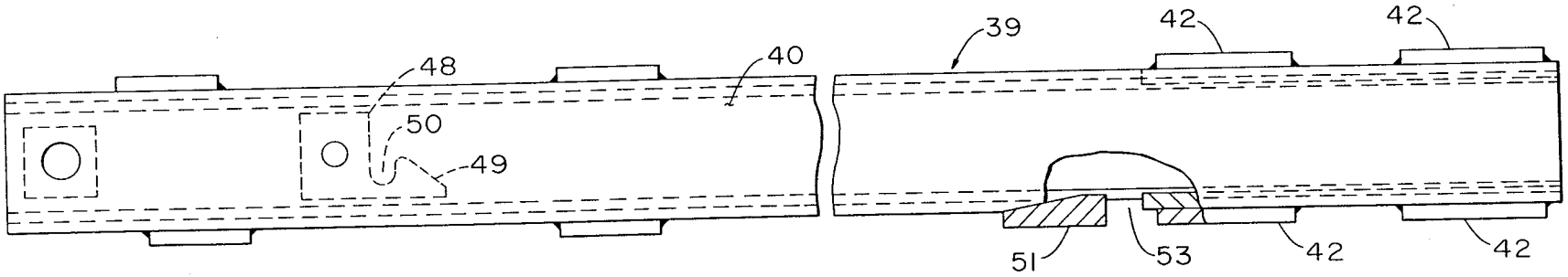
FIG. 7 is an elevational view of the details of the stationary member of the telescoping lever.
Figure 11:
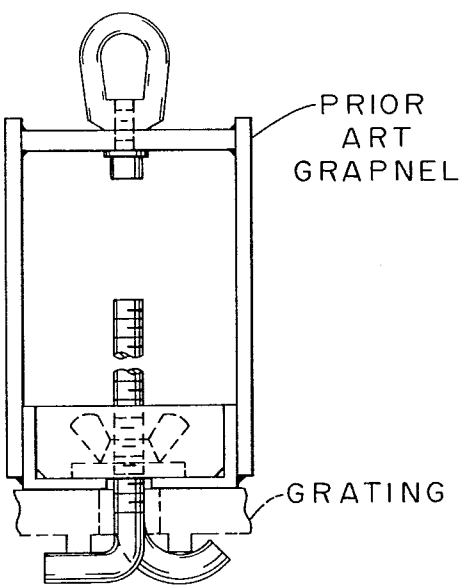
FIG. 11 shows an end elevational view of FIG. 10 taken on line XI—XI.

Another embodiment of the invention shown in FIGS. 5–7 comprises a lever, generally designated 37, constructed of two rigid beam members 38 and 39, one sized to slide telescopically for a distance within the other. Beam member 39 is constructed of spaced parallel steel channel members 40 and 41 joined with welded-on spacer-plates 42 in a manner similar to the lever of FIGS. 1–4. Beam 38 is a rectangular steel tube reinforced at the front end by a steel channel 38A and cross-braces 38B. A steel washer 38C is welded on one end of channel 38. At the back end of beam 38 is provided a tubular handle 30' similar in construction to that in the first embodiment and shown in FIG. 2. In FIGS. 5–7 the beam member 38 is sized to slide telescopically for a distance within the beam member 39 and has mounted within it, in the end opposite the end having the handle 30' a pivotable latching-piece 43. Latching-piece 43 has a stop 44 which projects downward into the opening between the channel members 40 and 41 and has a pin 45 projecting from each side of the latching-piece 43 in a direction perpendicular to the direction of the stop 44. The latching-piece 43 is pivotally mounted on a latch holder 46 (FIG. 5B) by means of pin 43A and is urged to pivot by a compression spring 47 mounted between a clip 62 attached to latchingpiece 43 by screw 63 and washer 38C.

The end of the beam member 39 that is attachable to the post 17 holds a catch which consists of two catch-pieces 48, one mounted inside the beam on each side of the channel formed by the channel members 40 and 41. Each of the catchpieces 48 is shaped to provide a ramp 49 and a retainer-space 50. When the beam 38 is moved to fully contract the lever, the latching-piece 43 encounters the catchpieces 48 and the pins 45 ride up the ramps 49 until they drop into the retainer-spaces 50 under the urging of the spring 47 on the latching-piece 43. A second catch 51 is provided within the beam member 39 near its open end so that when the lever is extended a specific distance by moving the slidable beam member 38, the stop 44 on the latching-piece 43 encounters the catch 51 and rides up the ramp 52 until the latching-piece 43 pivots against the urging of the spring 47 and the stop 44 drops into a retainer slot 53. A cable 54 is attached to the latching-piece 43 by means of clip 62 and extends through the spring 47 and the sliding beam member 38 to the vicinity of the handle 30' and terminates with a pull ring 64; this allows a worker to pull on the cable 54 and cause the latching-piece 43 to pivot against and compress the spring 47, thereby releasing the latching piece from either the catchpieces 48 or the catch 51. When the latching-piece 43 is engaged in either catch 51 or the catchpieces 48, the beam members 38 and 39 are locked together and the slidable beam member 38 cannot be moved in either direction relative to beam member 39.

Figure 9:
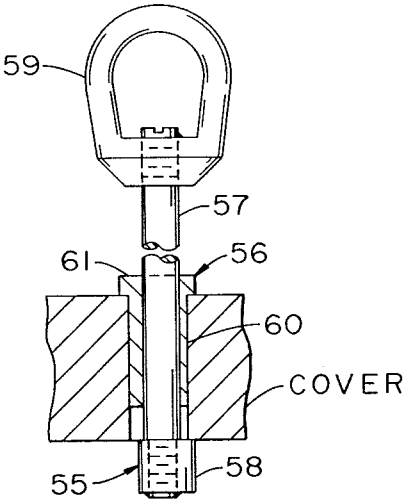
FIG. 9 shows the device of FIG. 8 in locked configuration.
Figure 8:
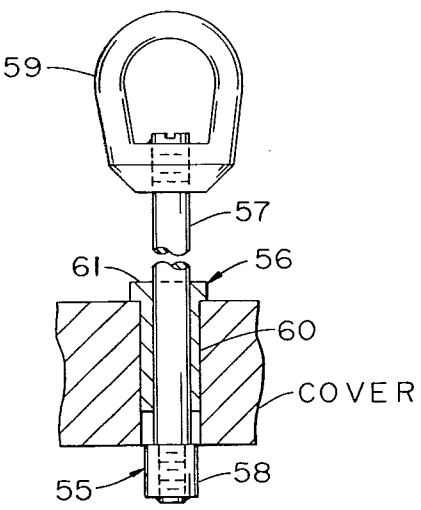
FIG. 8 shows, in an unlocked configuration, an alternate means of engaging a manhole cover that is suitable for attaching through a center hole in a cover.

A feature of my invention is that the lever can accommodate a variety of types of supplementary load-engaging means. For example, as illustrated in FIG. 1, a hook can be engaged to the lever and used to lift a grapnel of the prior art advertised in 1982 by Diversified Products and Engineering, Inc. (Monroeville, Pa.) suited to engage "pick holes" or lifting points at the perimeter of a cover, or a hook can be engaged to a device illustrated in FIGS. 8 and 9, which is a "double eccentric." The double eccentric, as shown in FIGS. 8A and 8B, is an assembly of an "eccentric" 55 and an "eccentric sleeve" 56. The eccentric consists of a rod 57 of circular cross-section having attached at its bottom end a cylinder 58 mounted to rotate eccentrically with the rod 57. An eye nut 59 is mounted on the top of the rod 57. The eccentric sleeve 56 consists of a cylinder bored-through on an axis different from but parallel to the axis of the cylinder 58 so that the resulting shaft 60 is eccentric. The top of the eccentric sleeve 56 has a flange 61. The double eccentric is used to engage a manhole cover through a center hole as will be described below and is particularly useful because many center holes allow "single eccentrics" and other means of attachment to slip out of the center hole and drop the load.

Figure 10:
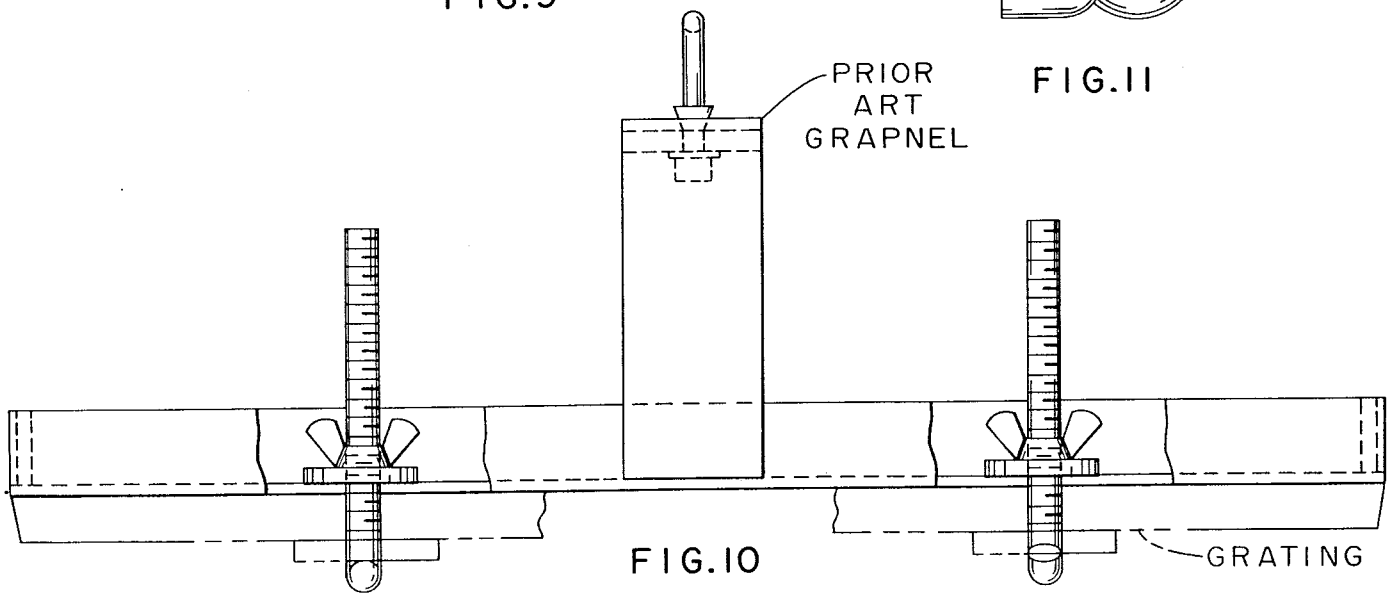
FIG. 10 shows an alternate means of engaging a load that is particularly suitable for gratings.

As another alternative, a lever of my invention can be attached by means of a hook to a prior art grapnel of the type illustrated in FIG. 10, also advertised by Diversified Products and Engineering, Inc., which is particularly suited to attaching to a grating. Another feature of my design is that the lever can accommodate more than one load-engaging means so that, for example, additional hooks can be attached in a similar manner to hook 33 at other locations along the lever. In particular applications, the use of a plurality of load-engaging means can prevent a load from swinging in an undesirable direction or unsafe manner when it is being moved.

METHOD OF USE

One method by which the device of the present invention may be used is as follows: With reference to FIG. 1–4, a suitable means for engaging the load, such as the grapnel illustrated for attaching to a manhole cover, is first attached to the load. The base 11 is then placed adjacent to the load and the lever 23 is attached to the pivotable post 17 at an optional elevation by selecting either of the positions designated 25 and inserting and securing the transverse pin 24. Next the operator lays the lever across the load. The means for engaging the grapnel, such as a hook, 33, is then adjusted on the lever to a position over the center of the load, adjusted for height and orientation, and tightened. The handle 30 is than grasped and the lever is moved to manuever the hook to engage the grapnel. The operator then raises the handle and lifts the load just high enough to clear the opening, and moves the handle either to the right or to the left in a horizontal plane to pivot the load away from the opening, and lowering the handle lowers the load into a new location. To replace the load into its original position the procedure is reversed. If the load is too heavy for one operator, a piece of pipe of appropriate length and diameter can be inserted through the handle 30; then one operator can be positioned to manuever the device from each end of the pipe and a third operator if necessary can take a position between the other two.

To use the described double eccentric to lift a manhole cover having a center hole, the eccentric 55 is adjusted by turning the eye nut 59 so that the cylinder 58 is aligned with the shaft 60 in the unlocked configuration shown in FIG. 8 and the assembly is inserted in the center hole so that the flange 61 rests on the cover. Rotation of the eye nut 59 then turns the cylinder 58 with double eccentricity compared to the axis of the center hole; when the eye nut 59 is turned 180 degrees the cylinder 58 reaches a maximum offset and is in the locked configuration shown in FIG. 9; the cover can then be lifted by engaging a lever 23 to the eye nut 59 with a hook 33. When a cover has been positioned as desired and the hook 33 disengaged, the eye nut 59 can be rotated 180 degrees to return the double eccentric to the unlocked configuration and allow it to be withdrawn from the cover. The relative position of markings on the double eccentric, such as a notch on the top of the rod 57 and a V-groove on the top of the flange 61, can be used to indicate to what position the eye nut 59 should be turned to configure the double eccentric for lifting a manhole cover or for withdrawing it from a cover.

To use the telescoping lever illustrated in FIGS. 5–7, the lever 39 is attached to the pivotable post 17 of FIGS. 1–4 and the device is used in the same manner as described for the non-telescoping lever 23 illustrated in FIG. 1 except that after the base 11 is placed adjacent to the load and the lever 39 is attached at a selected elevation to the pivotable post 17, the operator releases the lock mechanism (as described above) and extends the lever until the locking mechanism automatically locks the lever at its full length, in which configuration it will provide a maximum mechanical advantage. After the telescoping lever 37 has been used, the operator can pull the cable to unlock and contract the telescoping members and can also detach the lever from the post for convenience in storage or transportation.

While the present invention has been described in connection with particular embodiments thereof, it will be understood by those skilled in the art that changes and modifications can be made without departing from the spirit and scope of the following claims:

What is claimed is:

1. Apparatus for removing and replacing manhole covers and gratings comprising:

a base;

a first member mounted on the base for rotation about an axis perpendicular to the base;

a pivotable post mounted on the first member for rotation about an axis perpendicular to the axis of rotation of the first member and equipped at a plurality of elevationally different positions for the selective attachment of a lever;

a lever detachably engaged at one end to the pivotable post at one of said elevationally different positions, said lever including two spaced parallel longitudinal structural channels connected to form a rigid beam, said beam having a stop that butts against said pivotable post;

means attached to the lever at the end opposite said pivotable post to serve as a handle; and means for engaging a load located in the space between said structural channels and adjustable longitudinally of said lever within said space.

2. Apparatus as in claim 1, said lever comprising: two rigid beam members, one size to slide telescopically for a distance within the other.

3. The apparatus of claim 2 comprising locking means operable between said two beam members which automatically lock when said lever is adjusted to a predetermined length and prevent said telescoping members from sliding.

4. The apparatus of claim 3 comprising release means associated with said locking means that allows an operator to unlock and adjust the length of said lever.

5. The apparatus of claim 2 wherein one of said rigid beam members is attached at one end to said pivotable post and contains in each end a catch, the second of said beam members being the beam member sized to slide telescopically for a distance within said one beam member, and being the beam member to which the handle is attached, and having mounted within it a latching-piece in the end opposite the end to which the handle is attached, said latching-piece being urged by a spring so that when the length of the lever is adjusted by moving said sliding member and the latching-piece engages either catch in said one beam member, said beam members are automatically locked together and prevented from sliding; and a cable connected to the latching-piece and extending through the sliding member to the vicinity of the handle to allow an operator to pull on and compress the spring to thereby release the latching-piece.

6. Apparatus as in claim 1 in which said load-engaging means are attached at a plurality of points on said lever.

7. Apparatus as in claim 2 in which said load-engaging means are attached at a plurality of points on said lever.

8. Apparatus as in claim 6 in which a plurality of supplemental load-engaging means are attached to said load-engaging means.

9. Apparatus as in claim 7 in which a plurality of supplemental load-engaging means are attached to said load-engaging means.

10. Apparatus as in claim 1 in which said load-engaging means is elevationally adjustable.

11. Apparatus as in claim 2 in which said load-engaging means is elevationally adjustable.

12. Apparatus as in claim 1 in which said spaced parallel longitudinal channels are connected at regular intervals by welded-on spacer-plates.

13. Apparatus as in claim 2 in which said spaced parallel longitudinal channels are connected at intervals by welded-on spacer-plates.

14. Apparatus as in claim 1 in which said means attached to serve as a handle is a tubular member that allows the concentric insertion through it of a longer, smaller-diameter element to allow handling by a plurality of workers.

15. Apparatus as in claim 2 in which said means attached to serve as a handle is a tubular member that allows the concentric insertion through it of a longer, smaller-diameter element to allow handling by a plurality of workers.

16. Apparatus as in claim 1 in which said means for engaging a load is demountably attached to said beam with an eye bolt, the shank of the eye bolt passing between the structural channel members and through a mounting plate supported by the beam.

17. Apparatus as in claim 2 in which said means for engaging a load is demountably attached to said beam with an eye bolt, the shank of the eye bolt passing between the structural channel members and through a mounting plate supported by the beam.

* * * * *